US009358447B2

(12) United States Patent
Brown et al.

(10) Patent No.: US 9,358,447 B2
(45) Date of Patent: Jun. 7, 2016

(54) RAPID RESPONSE SKI BINDING

(71) Applicants: Christopher A. Brown, Cazenovia, NY (US); John M. Madura, Hewitt, NJ (US)

(72) Inventors: Christopher A. Brown, Cazenovia, NY (US); John M. Madura, Hewitt, NJ (US)

( * ) Notice: Subject to any disclaimer, the term of this patent is extended or adjusted under 35 U.S.C. 154(b) by 9 days.

(21) Appl. No.: 14/567,014

(22) Filed: Dec. 11, 2014

(65) Prior Publication Data

US 2015/0165304 A1 Jun. 18, 2015

Related U.S. Application Data

(60) Provisional application No. 61/914,577, filed on Dec. 11, 2013.

(51) Int. Cl.

| | |
|---|---|
| ***A63C 9/08*** | (2012.01) |
| ***A63C 9/24*** | (2012.01) |
| ***A63C 9/084*** | (2012.01) |
| ***A63C 9/085*** | (2012.01) |

(52) U.S. Cl.

CPC ..... *A63C 9/0805* (2013.01); *A63C 9/0842* (2013.01); *A63C 9/0846* (2013.01); *A63C 9/0855* (2013.01); *A63C 9/08578* (2013.01)

(58) Field of Classification Search

CPC .. A63C 9/0855; A63C 9/081; A63C 9/08564; A63C 9/0805; A63C 9/0842; A63C 9/0846; A63C 9/08578; A63C 9/24; A63C 9/08; A63C 9/00; A63C 9/082

See application file for complete search history.

(56) References Cited

U.S. PATENT DOCUMENTS

| | | | | |
|---|---|---|---|---|
| 3,415,530 A | | 12/1968 | Scheib et al. | |
| 3,512,797 A | * | 5/1970 | Hannes | A63C 9/0844 280/626 |
| 3,528,673 A | * | 9/1970 | Myerson | A63C 9/08 280/634 |
| 3,677,566 A | | 7/1972 | Lawrence | |
| 3,961,802 A | | 6/1976 | Vannatter | |

(Continued)

FOREIGN PATENT DOCUMENTS

WO 2006088811 A2 8/2006

OTHER PUBLICATIONS

Christopher, Brown A., et al., "A method for Improvement of Retention Characteristics in Alpine Ski Bindings", American Society for Testing and Materials, Philadelphia, 1985, pp. 224-237.

(Continued)

*Primary Examiner* — John Walters
*Assistant Examiner* — Hilary L Johns
(74) *Attorney, Agent, or Firm* — Chapin IP Law, LLC

(57) ABSTRACT

A ski binding heel employs a low-mass, spring-loaded interface between the heel and/or toe release mechanisms of the heel and or toe pieces of the binding and the ski boot, i.e., fast-response heel and toe cups. The low mass or lightweight fast-response heel and toe cup interfaces follows the dynamics of the ski to retain the boot during events that could cause inadvertent release (IR) in a conventional release binding. A biased, or spring loaded member engages, the boot heel/toe for mitigating loads and for absorbing sub-injury loads and compensating for movement between the boot and ski. The spring loaded members are biased toward the boot heel and toe for absorbing loads and compensating for displacements that might otherwise result in an inadvertent release. The spring loaded toe/heel cups permit movements of the boot relative to the ski flexing and counter flexing that might have otherwise resulted in an IR.

16 Claims, 9 Drawing Sheets

Load - Displacement plot

(56) References Cited

U.S. PATENT DOCUMENTS

| | | | | |
|---|---|---|---|---|
| 4,385,773 | A * | 5/1983 | Scheck | A63C 9/081 280/612 |
| 4,494,768 | A * | 1/1985 | Hull | A63C 9/0802 280/612 |
| 4,624,474 | A | 11/1986 | Klubitschko et al. | |
| 5,265,901 | A | 11/1993 | Gorza | |
| 5,280,942 | A * | 1/1994 | Ruffinengo | A63C 9/00 280/602 |
| 7,318,598 | B2 | 1/2008 | Howell | |
| 7,523,953 | B2 * | 4/2009 | Ettlinger | A63C 9/081 280/14.23 |
| 7,887,084 | B2 | 2/2011 | Howell | |
| 2002/0101063 | A1 * | 8/2002 | Dodge | A63C 9/0844 280/624 |
| 2004/0173994 | A1 * | 9/2004 | Howell | A63C 9/001 280/628 |

OTHER PUBLICATIONS

Alexis Bally, et al., Modeling Forces on the Anterior Cruciate Knee Ligament During Backward Falls while Skiing, American Society for Testing and Materials, Philadelphia, 1989, pp. 267-276.

Jonathan D. Webster, et al., Computer Simulation of the Loads on the ACL During Backward Falls Based on an Open Kinematic Chain Model, American Society for Testing and Materials, 1996, pp. 254-269.

* cited by examiner

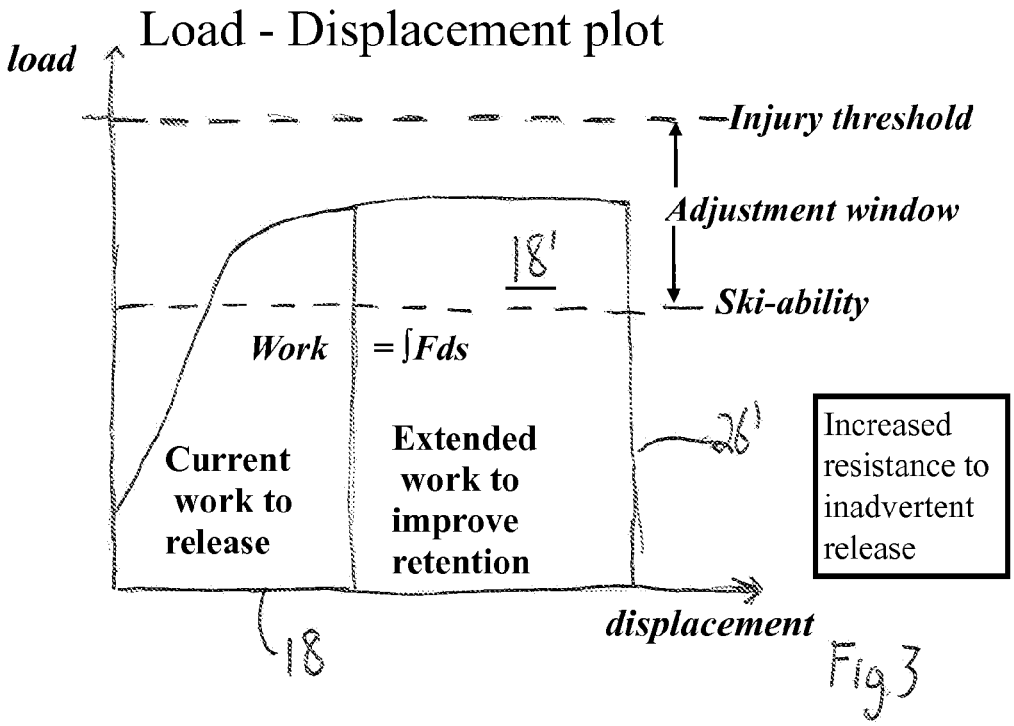
Load - Displacement plot
load
Injury threshold
Adjustment window
18'
Ski-ability
Work = ∫Fds
Current work to release
Extended work to improve retention
26'
Increased resistance to inadvertent release
displacement
18
Fig 3

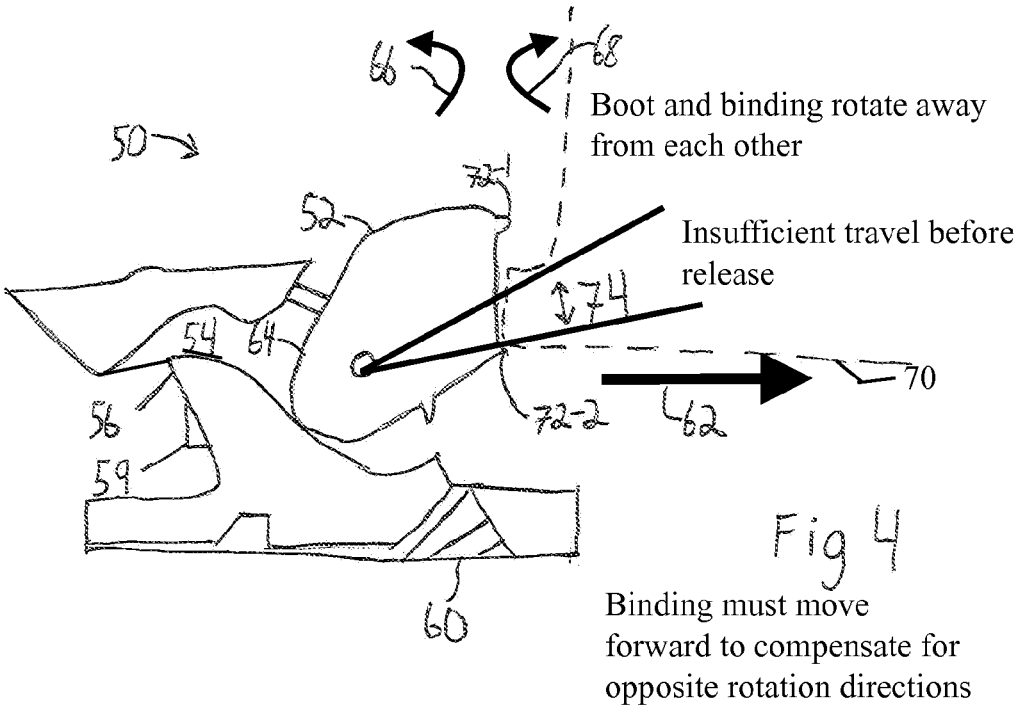
66
68
Boot and binding rotate away from each other
50
72-1
52
Insufficient travel before release
74
54
64
70
56
72-2
62
59
60
Fig 4
Binding must move forward to compensate for opposite rotation directions

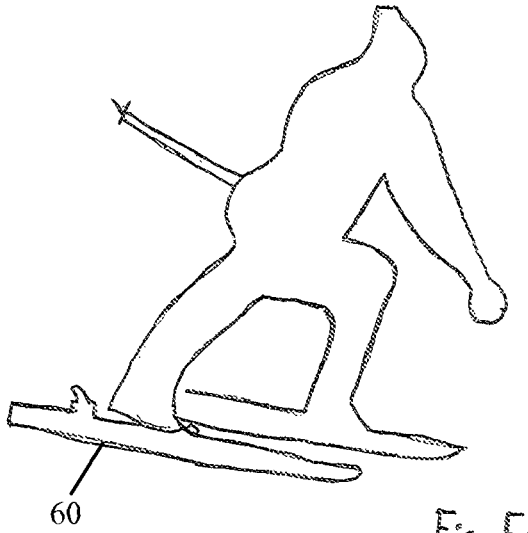
Fig 5e
Ski doesn't stay on when it is flexing
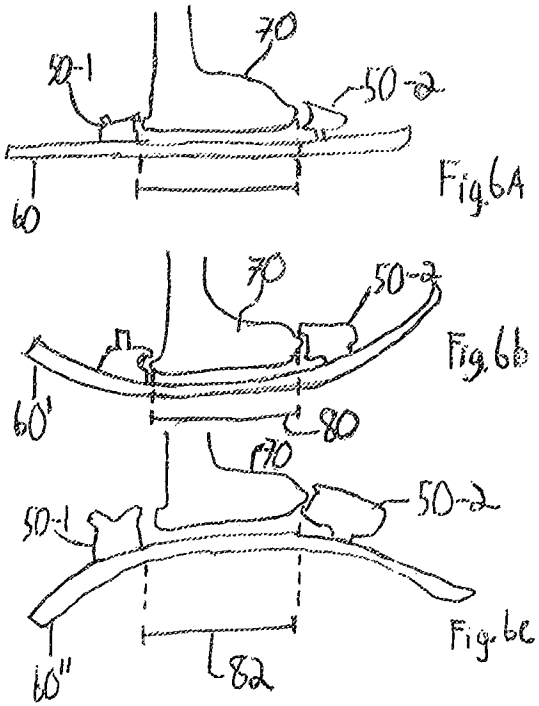

RAPID RESPONSE SKI BINDING

RELATED APPLICATIONS

This patent application claims the benefit under 35 U.S.C. §119(e) of U.S. Provisional Patent App. No. 61/914,577, filed Dec. 11, 2013, entitled "SKI BINDING HEEL," incorporated by reference in entirety.

BACKGROUND

Conventional ski bindings prevent ski injuries by releasing the skier's leg from relatively stiff communication with the ski when forces deemed to be injurious are applied to the ski, as in a ski fall. Early ski bindings held the ski boot, and thus the leg and ankle of the skier, in firm communication. It was soon realized that the twisting loads that the ski can apply to a falling and tumbling or rolling skier can be substantial. So called "safety bindings," which maintain communication, i.e., transmit loads, between boot and ski only up to a predetermined threshold force, and are intended to release the ski before a lower-extremity equipment-related (LEER) injury occurs, have been the norm for more than forty years.

Modern ski bindings have a heel and toe pieces for retaining corresponding portions of a ski boot (boot), typically in spring loaded cam devices with toe and heel cups adapted to engage a protrusion on the boot heel and toe. The spring loaded cam systems allow the toe and heel cups to rotate and release the boot to prevent the transmission of potentially injurious loads to the skier. Typically, rotation of the ski boot out of alignment with the toe of the ski occurs from pivoting or rotating movement of the cups on the binding toe or heel pieces. The toe and heel pieces are set to retain the boot in engagement with the ski, typically by preloading the release spring in a spring-cam biased retention system. When certain bending, twisting or rotation loads exceeding certain predetermined loads occur, the binding heel piece allows the heel cup to rotate up, and on some bindings laterally as well, or the binding toe piece allows the toe cup to pivot right or left, and on some designs up as well, to allow the boot to release from the ski and binding, typically from a downed skier rolling or tumbling across the snow surface. The threshold release loads for the toe and heel pieces, however, need to be identified, adjusted and calibrated in an adjustment window order to prevent injuries from loads that do approach the injury thresholds and to prevent inadvertent releases from skiing maneuvers, such as recoveries, that might produce loads that are larger than usual but still do not approach the potentially injurious, or harmful, loads.

SUMMARY

Many ski bindings transmit loads from the skier's leg to the ski by engaging a pair of bindings fixed to the skis at the heel and toe of the ski boots worn by the skier. The ski bindings therefore operate as an interface between the skier and the ski for transmitting loads to control the ski. Many ski bindings also maintain a spring biased release mechanism to disengage the boot from the ski by one of two strategies: if loads either approach an injury threshold deemed to be approaching those which would be potentially harmful to the skier's lower extremity or if they exceed the highest loads required for skiing still below those approaching injury, which might typically be generated in a sudden stop or turn or in some kind of dynamic recovery maneuver. Usually the release threshold is met during a fall or failed recovery maneuver, when a rolling or tumbling movement of the skier causes the ski to transmit forces approaching a potentially harmful magnitude to the skier.

Configurations herein are based, in part, on the observation that ski bindings implement a release designed to disengage the boot, and thus the skier, from attachment to the ski to prevent transmission of potentially injurious loads during a fall, or an overly aggressive maneuver, when the loads transmitted through the ski approach a magnitude that could potentially cause injury.

Unfortunately, conventional approaches to ski binding release mechanisms suffer from the shortcoming that conventional release mechanisms employ a release system which disengages the boot not only upon an application of loads deemed to be approaching those that could be potentially injurious, but also responsive to forces that mimic harmful scenarios to result in an inadvertent release. This can occur under certain dynamic situations when the ski is flexing and counter flexing, or when the binding does not have enough displacement to adsorb certain loads or shocks. In the latter case loads or shocks can be absorbed by work done on the boot binding system. This can be evident by displacement of the boot relative to the ski under load. The combined load and displacement represent energy adsorbing work done on the binding. This energy adsorbing displacement of the boot and binding relative to the ski can occur without risking LEER injuries in an appropriately designed and functioning ski-boot-binding system. Devices which extend the displacement in the system before release of the boot by the binding, without dangerously increasing the loads on the leg, will provide superior binding performance though reducing the risk of inadvertent release while not increasing the risk of injury.

Conventional approaches to testing release functions are usually based on quasi-static loads applied to the boot, and are calibrated based on a boot engaged in bindings on a stationary ski, recording only the peak loads, with no simultaneous measure of displacement of the boot relative to the binding. Conventional approaches to testing do not measure the work to release nor do they anticipate or address dynamic loads and shocks encountered during skiing and the flexing and counter flexing of a ski in use. Therefore they cannot detect if a binding might be especially susceptible to inadvertent release or particularly good at avoiding it.

The only way most skiers currently think that they might avoid inadvertent release is to increase the DIN or visual indicator settings that indicate the preloads on the larger springs in the bindings that control release, thereby increasing the loads prior to release and reducing or eliminating the margin where the release should be set between release loads and injury loads. Increasing the settings for the release loads puts the skier at greater risk of a lower extremity equipment related (LEER) injuries.

Conventional bindings typically have relatively heavy springs in the spring-cam system that control the release loads. These springs compress against cams to allow the toe cup and heel cups, which provide the interface between the binding and the boot, to rotate, or pivot, to release the boot. The toe cup rotates laterally and in some cases vertically as well. The heel cup rotates vertically and in some cases laterally as well. The preload on these springs, which control the release, can be adjusted to account for the individual skier, usually by a system that can include the skier's weight, height, boot sole length, age and skiing style.

Conventional bindings also have a relatively light spring that pushes the heel piece forward on a track in order to capture the boot between the toe and heel piece firmly, or snuggly, to avoid perceptible motion between the boot and binding under loads lighter than those where motion for release is initiating. This spring, often referred to as the forward-pressure spring, needs to be partly compressed when the boot is inserted in the binding. This need for compression limits the stiffness of the forward-pressure spring. If the forward pressure is too stiff it could be difficult or impossible to put the ski on, especially in soft snow. The forward-pressure spring is further compressed when the ski flexes. And the forward-pressure spring should push the heel piece forward to retain the boot, so that the heel cup remains engaged with the boot heel and the boot is thereby retained, when the ski un-flexes and counter-flexes and there is no risk of injury. However due to the weight of the heel piece, resistance to motion on the heel track and the requirement that the forward-pressure spring cannot be too stiff, the response of the heel piece can be too slow relative to the flexing, un-flexing and counter flexing of the ski and inadvertent releases occur in these situations.

Accordingly, configurations herein substantially overcome the above described shortcoming of susceptibility to inadvertent release (IR) by disposing the fast-response toe and heel cups which are slideably mounted and spring-loaded. These fast-response toe and heel cups are spring biased components with relatively small masses that provide a fast-response shock-absorbing interface between the relatively large primary mass of the main heel and toe pieces of the binding and the boot that is robust with respect to the accommodating flexing of the ski and other loading and displacements which could cause inadvertent release. The main heel and toe pieces house the relatively heavy springs and cams that provide the normal, controlled and intentional release, and the boot. The fast-response toe and heel cups, being lighter, have a faster response for the same stiffness springs, than does the heavier entire binding with the conventional, intentional release mechanism. A binding with the fast-response heel and/or toe cups is therefore better adapted for the dynamic loads experienced during recovery maneuvers turning or stopping, particularly on firm snow or ice.

Configurations herein dispose fast-response toe and heel cups comprising interfaces with the toe and heel of the boots slideably attached with the main-heel and main-toe pieces which are the primary masses of the ski binding. The fast-response toe and heel cups have a lighter mass and has a higher response frequency for the same stiffness forward pressure spring than does the current heel piece, thus it responds more quickly than the conventional binding alone. The fast-response heel and toe cups are biased by a spring or other resilient elastic compression member, and the lower mass so that even with the same spring stiffness as the current forward pressure springs they results in a combination that better maintains communication for retaining the boot in situations that might result inadvertent release (IR) in current bindings. The toe and/or heel cups also faithfully transmit control loads between the skier and ski through the binding and the boot required for executing maneuvers.

It should be noted herein that the ski binding pieces (toe and heel) and the toe and heel cup, are often referred to as "tensioned" to address the force holding them against the boot by a spring. While, strictly speaking, this may be described as a compression force, as the biasing results from a compressed spring, the tension so described refers to this bias, as the binding and toe/heel cups themselves cannot really be "compressed."

In particular configurations discussed below, these fast-response heel and toe cups secure a ski boot to the main heel and toe pieces, and include binding boot-heel and boot-toe receptacles, adapted to engage a heel and toe of a ski boot for transmitting control loads and are shaped so as to not to interfere with displacement during release. In this manner, the main bodies of the toe and heel pieces of the binding are mounted on a ski and have attached to them fast-response heel and toe cups, which are slideably mounted on main bodies of the heel and toe pieces. In a particular configuration, the fast-response heel and toe cups are disposed between the main bodies of the heel and toe pieces and the boot heel and toe and biased by compression springs against the heel and toe of the boot. The mass of the fast-response heel and toe cups is less than the mass of the entire heel piece for allowing faster dynamic responses.

The fast-response heel and toe cups, in the example arrangement, take the form of spring loaded members, which are responsive to loads exerted by the boot heel against the binding heel piece, and by the boot toe against the toe piece, such that the system permits movement of the spring loaded member relative to the main portions of the toe and heel piece. The spring loaded member, depicted herein as a toe or heel cup, has an engaging surface for engaging the boot heel and is slideably attached through rods to compresses a spring on an opposed side for attachment to the main bodies of the heel and toe pieces of the binding, and the spring or other compressible component or system (e.g., pneumatic, hydraulic or electromagnetic) is attached between the binding heelpiece or toe-piece and the spring loaded member. Alternately or additionally, the spring loaded members could pivot or slide on an arc with the boot heel or toe on an appropriate axis (e.g., parallel to the main rotational axis for release) to retain the boot heel or toe through greater movement prior to release. By spring loaded pivoting or sliding on an arc to counter the release pivot, by straight or curved extension of the heel or toe cups, the system would thereby increase the displacement of the boot relative to the ski before release, and the therefore energy that can adsorbed by the binding, without increasing the loads on the skier to those that might cause injury with a stiffer coupling or higher release setting, and adsorbing energy that might otherwise cause injury or result in a release.

It is not necessary to have these moveable heel cups, which are described above, on both the toe and heel to receive some of the benefits described above. The redundancy on the toe and heel could help in situations where the boot for any reason remains biased toward either the toe or heel piece during flexing, unflexing and counter flexing of the ski so that the boot would escape in a situation where there is no risk of injury.

In addition by adsorbing energy by displacement and loads below those that could potentially cause injury the ski can remain attached, without putting the skier in danger of injury, in situations where it would otherwise have had to release had the coupling been stiffer, i.e, less compliant, as the potentially injurious loads are approached. This sock adsorbing function serves to limit loads seen by the skier without releasing the boot from the binding.

Additional configurations include a guide pin or pins and guide pin receptacle(s), in which the guide pin extends from the spring loaded member for engaging the guide pin receptacle in the binding heel or toe, and the movement is restricted to be along an axis, possible curved, of the guide pins for limiting lateral movement away from the guide pin axis. The pins can have a verity of cross sections including round or rectangular or oval.

Alternative configurations can also include sliding shells with appropriate bevels or rubbery, possibly accordion-like, covers that cover the gap between the main bodies of the heel and toe pieces and the movable extensions of the fast-response toe and heel cups. This arrangement would serve to keep snow and ice and dirt out of the mechanisms and interfaces and prevent pinching of fingers in the interfaces.

In an alternate configuration, by controlling the pressure required to hold the boot firmly and snuggly between the fast-response toe and heel piece, with springs or other pressure means in the toe and heel cups, the track and spring under the heel piece can be eliminated. This reduces the weight and allows this space to be eliminated or used for adsorbing vertical loads with a spring system perhaps preloaded to prevent significant motion during normal loading, that could respond and protecting the ACL from boot induced anterior (BIAD) loads or allow the heel piece and boot heel to be lowered relative ski, or allow for lowering of the entire boot relative to the ski.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

FIG. 3 shows the energy and work for initiating a binding release according to FIG. 2;

FIG. 4 shows boot heel retention in a conventional prior art binding;

FIGS. 5*a*-5*e* show oscillating movement, or chatter, leading to inadvertent release (IR);

FIGS. 6*a*-6*c* show flexing of a ski resulting in IR;

DETAILED DESCRIPTION

Figure 1:
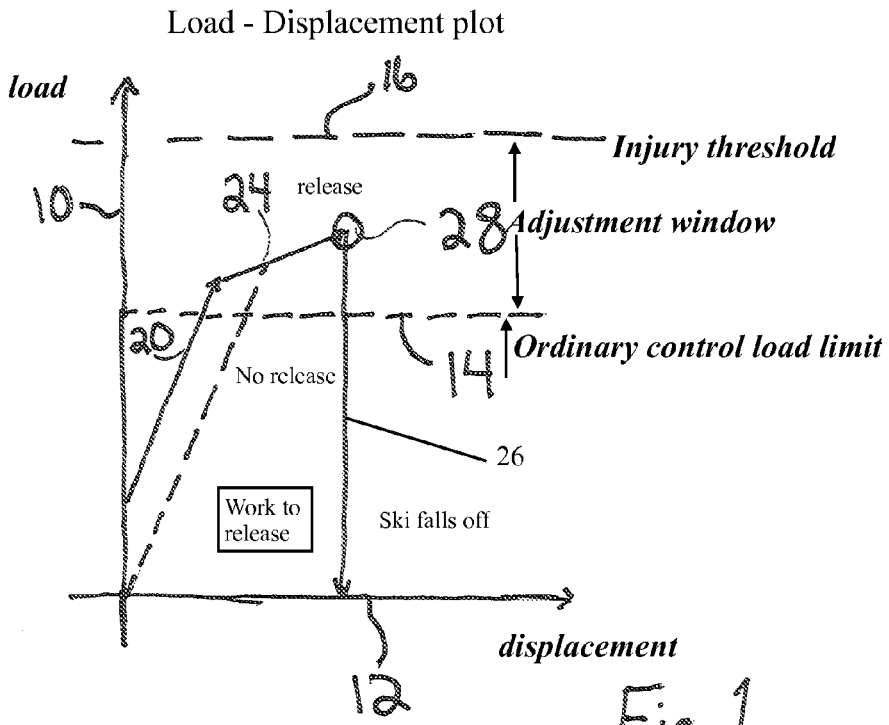
FIG. 1 is a graph of load-displacement in a conventional ski binding depicting the normal control, release and injury thresholds.

Generally, ski bindings are installed in a heel and toe pair, each with separate but corresponding preloads in a spring-cam system defined to retain the skier for ordinary skiing and recovery maneuvers below the injury threshold. The preloads are commonly indicated on the housing of the binding and referred to as visual indicator or DIN settings. Toe pieces pivot sideways or have a toe cup that pivots side ways around an approximately vertical axis approximately normal to the plane of the ski, and disengage the boot toe sideways. In some cases the toe piece or toe cup can also pivot upwards. Heel pieces, in conventional approaches, release by pivoting upwards or have a heel cup which pivots upward about an axis parallel to the plane of the ski and perpendicular to the length, such that the boot heel exits upwards. In both cases, skiing maneuvers generate loads that operate against the biasing force holding the boot engaged in the binding, and displace to release the boot once the threshold force is reached.

The toe and heel piece could have two or more movable fast-response toe and heel cup systems to convert release motions in different directions, thus retaining the boot through greater release rotation of the heel and toe cups and delay release, by increasing the displacement for retention prior to release, allowing for more energy to be adsorbed by the binding before release and improving retention without increasing the loads on the leg to potentially injurious levels when the systems, including preloads on the springs, are adjusted properly. The fast-response heel and toe cups, can thereby mitigate the loads that would otherwise have caused injury or release. Alternatively, or in addition, the fast-response elements could be included on boot toe and heel extensions that engage the binding.

The geometry of the heel cup facing the boot should be such that the upper ledge of the boot toe and heel are appropriately engaged through the sliding and release movements of the binding system and the lower portion of the boot toe and heel are generally not contacted during the movements intended to provide retention. The heel cup could have the conventional treadle that would normally be engaged by the sole of the boot heel to enter the binding.

Conventional ski bindings, however, employ a single, forward pressure spring system, which can be loaded dynamically through the movement of the mass defined by the weight of the heel piece of the binding and in any case acts through the heel piece pushing forward towards the toe piece, at the heel, in order to hold the boot firmly and snuggly in the toe and heel cups. The release threshold is represented by the compression of the larger springs in the main bodies of the toe and heel pieces, and these preloads are set to release the boot below injury thresholds, representing transmitted loads of a magnitude approaching those sufficient to potentially cause injury. The release thresholds, however, are tested by quasi-static loads, torques or forces, applied to the ski binding, and most tests do not encompass dynamic loads experienced during skiing. These dynamic loads can cause inadvertent release of the bindings even when a skier is not out of control, or is able to recover control or is not experiencing a fall or exigent circumstances which could lead to LEER injuries. Such inadvertent releases (IR) can also cause injury by the resulting fall from the loss of control because of the disengaged ski, which can result in the skier going off the trail and/or into a stationary object such as a tree or structure, or falling off a steep grade or ledge, or colliding with another person.

IR situations may occur during high speed, aggressive maneuvers such as those in competitive skiing, but can also occur in less intense contexts. Studies have shown that the incidence of IR affects a significant portion of competitive skiers, and may also be difficult to track because it can be difficult to determine if the binding release caused the fall or vice-versa and there is no system for reporting and tracking IR.

In particular, one scenario that can be prone to cause IR events is a rapid cyclic flexing or oscillation of the ski that may occur during high speed turns, particularly on hard snow or ice, colloquially known as "chatter." A chatter situation causes the ski to rapidly flex and counter flex between concave and convex positions, and is most notable during slow motion views of competitive skiing. When chatter occurs, the straight-line distance between the attachment points of the heel and toe piece of the bindings vary as the ski flexes. Since the bindings attach to the boots slightly above the plane of the ski, a convex arc tends to draw the heel and toe bindings outward, while a concave arcing pulls them together. A high speed oscillation of the ski may occur faster than the spring loaded binding can respond, and cause the boot to disengage as the attachment point of the binding is drawn out of communication with the heel piece or toe piece and disengages.

Static testing cannot address chatter situations because the ski remains unflexed, and conventional ski binding tensioning (or release/retention setting, commonly referred to as a "DIN" setting) is applied to a stationary ski. Dynamic loads such as chatter are assumed to be compensated by the fairly rigid arrangement of the ski binding mass and spring biased loading, however. Inadvertent release in chatter situations can result because the ski has a higher natural frequency than the binding, and the spring and mass of the binding cannot respond quickly enough to prevent an IR, causing the ski and boot to disengage and resulting in the fall and possible injury that the binding was expected to prevent.

FIG. 1 is a graph of load-displacement in a conventional ski binding depicting the normal control loads, release loads and injury thresholds. Referring to FIG. 1, a load axis 10 indicates forces against the binding tending to cause release, such as from a skier executing a turn at high speed. A displacement axis 12 corresponds to movement of the binding until release. A control load limit 14 approximates forces within normal controlled skiing, and an injury threshold 16 defines a force injurious to the skier, and prior to which the binding should disengage the ski. During ski maneuvers, force applied against the binding follow the line 20 as the binding begins to displace. At point 22, after the control threshold, displacement occurs more rapidly along line 24, until displacement is sufficient to disengage the boot from the ski, as line 24 crosses a disengagement threshold 26, prior to the injury threshold 16. The intersection 28 occurs when the work performed is sufficient to displace the binding to the point of disengagement with the boot. The area under the curve 18 defines the work to trigger release, as computed by a skiing load force exerted on the binding through a distance for displacing the binding sufficient to release. In a modern ski binding, which may have a relatively small protrusion to secure a boot into engagement with a heel receptacle on the binding, the displacement required to disengage is small, increasing the frequency for IR.

Figure 2:
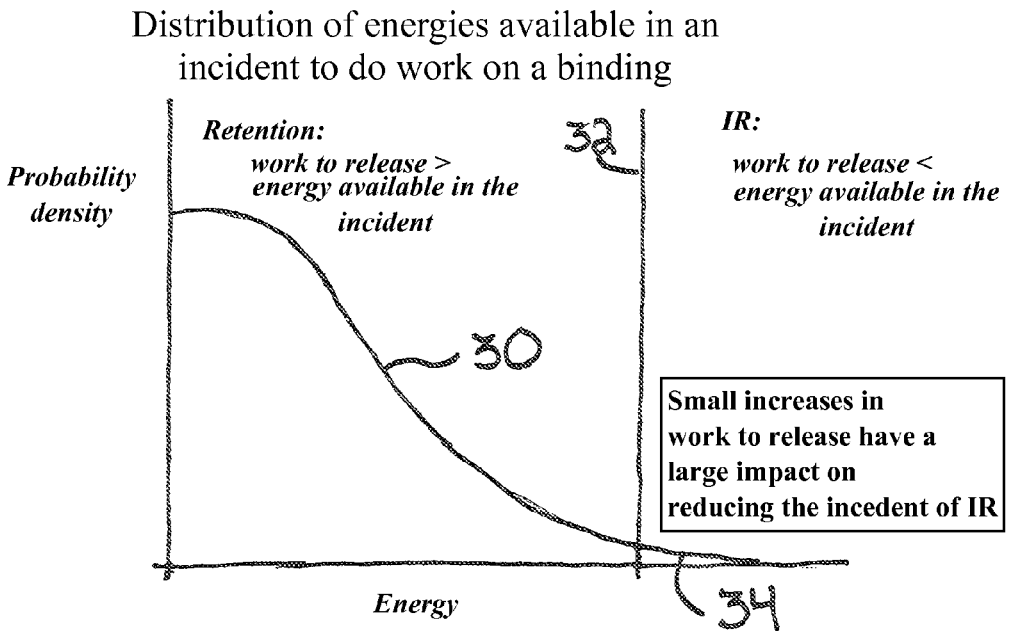
FIG. 2 shows a distribution of energy/work in a binding as in FIG. 1 pending a release.

FIG. 2 shows a distribution of energy in a binding as in FIG. 1 pending a release. The curve 30 shows the energy available to do work on the binding; in other words, the acting forces which displace the binding through a distance until release. As will be discussed further below, a release threshold 32 denotes release. As the release threshold 32 increases, meaning that increased energy is required to trigger a release, the probability of inadvertent release decreases, as shown by the area 34. Small increases in the work required to cause a release have a large impact on reducing an IR situation.

FIG. 3 shows the energy and work for initiating a binding release according to FIG. 2. Since the release threshold 26 is more properly defined as a force through a distance (i.e. work), rather than simply a threshold force, the IR protection as defined herein characterizes binding release as a quantity of work to release. Referring to FIGS. 1-3, the area 18' represents additional work required (such as binding movement due to chatter) until binding release, depicted by improved release threshold 26'. In other words, as chatter and similar, relatively minor forces displace the binding, an IR is avoided as these forces are absorbed by the secondary mass and pressure springs in the toe and heel cups, rather than combining at an inopportune time to complete the relatively small quantity of work 18 triggering release, depicted in FIG. 1.

FIG. 4 shows boot heel retention in a conventional prior art binding 50. Referring to FIG. 4, the binding 50 includes a heelpiece 52 defining a mass 54 and a mounting 56. The mounting 56 slideably engages a track 58 biased by a spring 59, and the track 58 attaches the binding 50 to a ski 60, typically by bolts, screws, or other fixed attachment. The spring 59 biased binding 50 applies force forward towards a boot 70, engaged between upper and lower protrusions 72-1 . . . 72-2 (72 generally), as shown by arrow 62. A pivot 64 allows angular displacement of the heelpiece 52 from the mounting 56, and is also biased by the spring 59. Alternatively, a separate spring may bias the heelpiece 52. Upon a release event, the heelpiece 52 displaces upward, around pivot 64, as shown by arrow 66. IR occurs, in part, because the boot 70 displaces according to an opposite rotation, centered at the toe, as shown by arrow 68. IR potential is exacerbated because protrusions 72 are often undersized and permit boot 70 release after only a small angular travel 74.

Figure 5A:
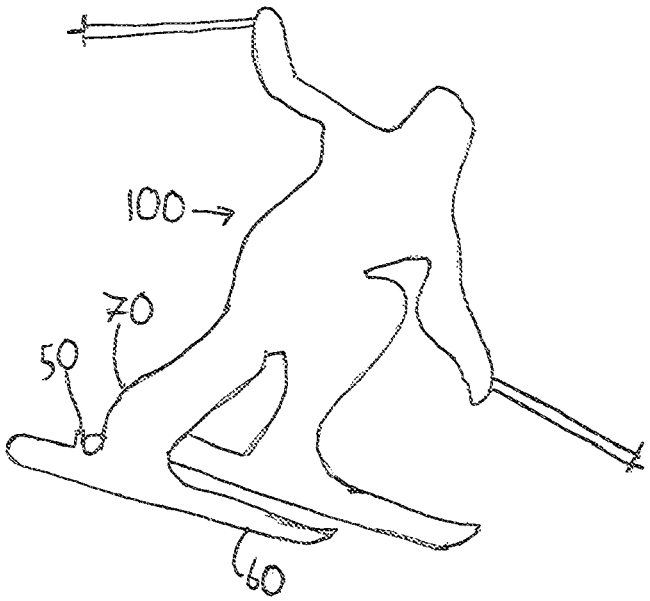
Figure 5B:
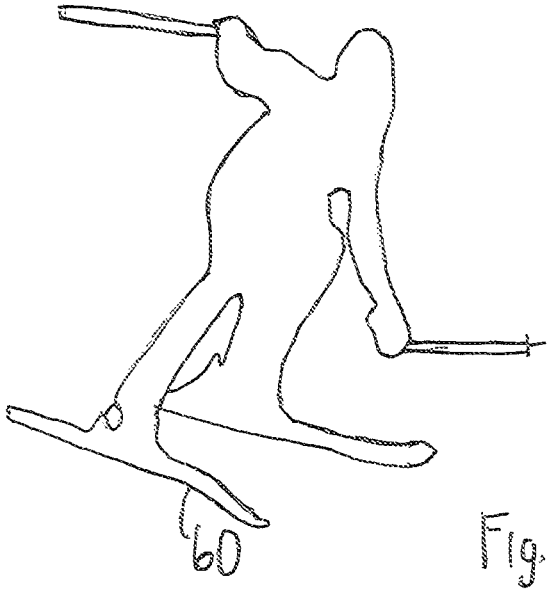
Figure 5C:
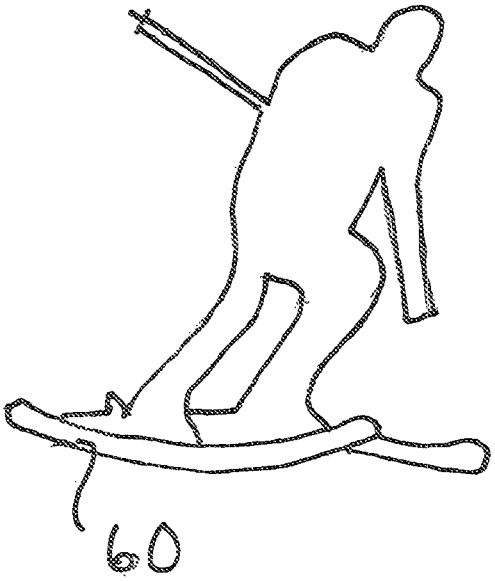
Figure 5D:
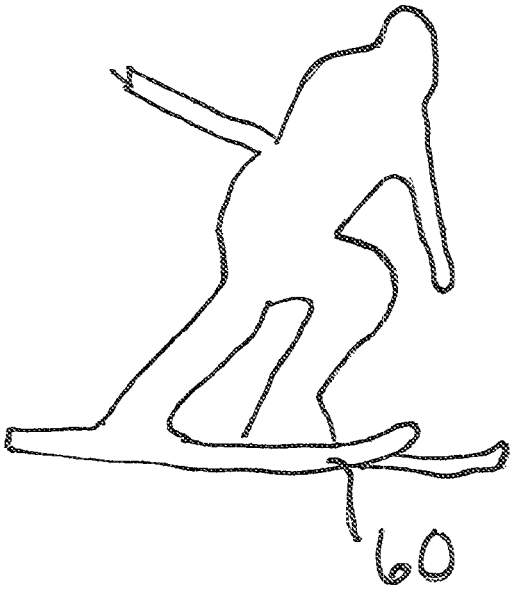

FIGS. 5*a*-5*e* show oscillating movement, or chatter, leading to inadvertent release (IR). FIG. 5*a* shows a skier 100 navigating a turn. As the skier cuts into the turn, the ski 60 flexes upward, defining a concave deformation of the ski 60. The boot 70 remains engaged in the binding as the ski 60 flexes oppositely, shown by the convex arc in FIG. 5*b*. In FIG. 5*c*, the ski 60 flexes back to the convex deformation, and back to concave in FIG. 5*d*. At FIG. 5*e*, the flexing of the ski 60 displaces the binding 50 away from the ski due to chatter, and the ski detaches in an IR situation as the spring biased binding cannot recover quickly enough to the convex arc of the ski 60.

FIGS. 6*a*-6*c* show a side view flexing of a ski resulting in IR, as depicted in FIGS. 5*a*-5*e*. In FIG. 6*a*, the ski 60 remains at rest as the boot 70, engaged between a heel (rear) binding 50-1 and toe (front) 50-2 binding (50 generally). As the ski 60' flexes in a concave manner, a distance 80 between the bindings 50 shortens as the deformation draws the bindings 50 together. As the ski deforms oppositely to a convex shape 60", the bindings 50 are drawn apart and the linear distance 82 increases to the point where the bindings 50 cannot engage the boot 70, resulting in an IR.

Figure 7:
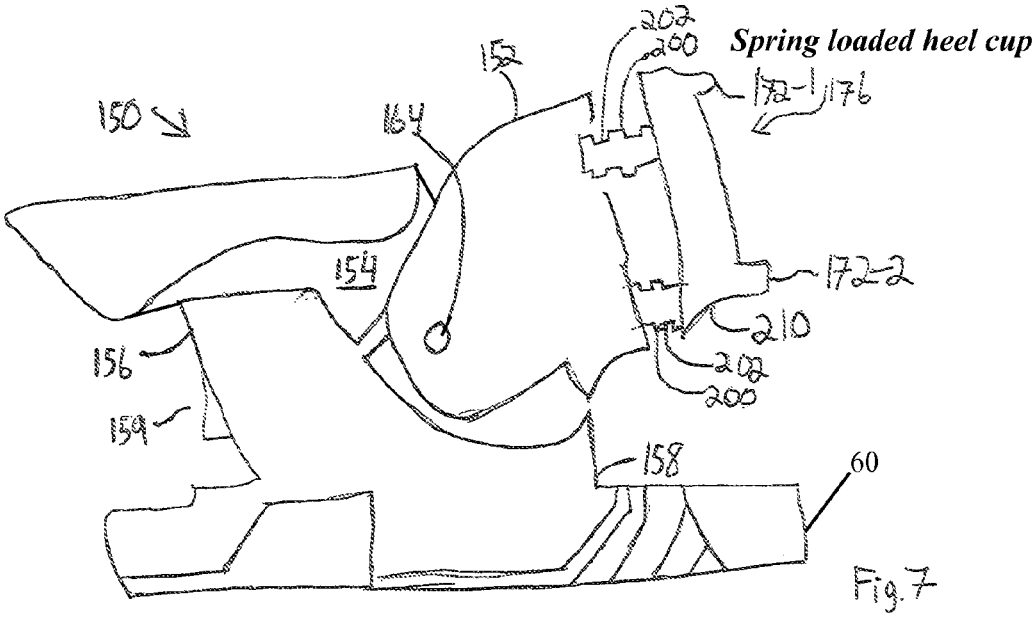
FIG. 7 shows a binding according to configurations herein.

FIG. 7 shows a binding according to configurations herein. Referring to FIG. 7, the ski binding 150 as disclosed herein includes a heelpiece 152 pivotally attached to a mounting 156 at a pivot 164. The mounting 156 defines a mass 154, which may be spring 159 biased via a track 158 to the ski 60 or may optionally be mounted directly to the ski 60.

Configurations herein dispose fast-response heel and toe cups (a secondary mass) between the main body of the binding (primary mass) and the ski boot 70, for enabling a biased (spring loaded or similar) response to high frequency loads and other loads which tend to induce IR. Accordingly, discussed further below is a ski boot attachment interface for engaging a ski boot 70 to a ski 60, including one or more tensioned masses disposed between a ski boot and a mounting on a ski, such that each of the masses is biased against the ski boot 70. The tensioned masses further include the primary mass 154 biased against the ski boot for securing the boot to the ski against a threshold force indicative of injury, and a secondary mass defined by a heel cup 210 (secondary mass) disposed between the primary mass 154 and the ski boot 70 and biased to exert a different force than the primary mass 154, such that the secondary mass 210 engages the ski boot 70 for absorbing a load less than the threshold force for preventing inadvertent release (IR). The threshold force defines a displacement of the primary mass 154 sufficient to release the ski boot 70 from the engagement with the ski 60, and the secondary mass 210 is configured for displacement at a lesser force than the threshold force for absorbing displacement corresponding to an IR without disengaging the ski boot 70 from the ski 60. In the example configuration, the secondary mass 210 is configured to absorb a load for increasing work required for triggering a release by disposing the primary mass against a threshold force indicative of injury, as depicted in the graphs above.

In an alternate configuration, to provide the so-called forward pressure to hold the boot firmly, or snuggly, between the toe and heel pieces, particular configurations may employ only the fast-response heel and/or toe cups, in lieu the forward pressure spring forcing the main-housing of the heel piece forward in a track. In such an embodiment, the main-toe-piece and main-heel-piece can remain in a fixed position mounted on the ski. The fast-response heel and/or toe cups simply respond(s) according to the higher natural frequency of their smaller masses for addressing elastic deformations of the ski caused by chatter and other dynamic loads. Such a configuration also allows the main-heel piece to be mounted closer to the ski since the track and forward pressure spring mechanics are not needed. In this configuration, a fixed heel piece defines the primary mass, and the secondary mass is defined by a fast-response-heel or toe cup with lighter mass than the fixed heel piece, the fast-response-heel-cup adapted to respond to and follow relative displacements between the binding toe and heel pieces resulting from dynamic loadings.

The heelpiece 152 includes one or more pins 200 biased by corresponding springs 202 to a heel cup 210. The heel cup 210 defines a secondary mass having a faster response than the primary mass 154 defined by the mounting 156, to align with the natural frequency of the ski 60 during chatter and other IR inducing scenarios. The heel cup 210 includes protrusions 172-1 . . . 172-2 (172, generally) defining a receptacle 176 for engaging a boot 70 heel.

The pins 200 define a linear response to loading the springs 202 biased against the boot 70, and may include any suitable number of pins or similar elongated members for linear biasing against the heel cup 210 for maintaining engagement with the boot 70. A larger, unitary shaft, preferably shaped to prevent rotation, may also be employed as a sleeved arrangement, which guards against snow and other materials from potentially interfering with the spring 202 and pin 200 biasing.

Therefore, configurations herein include at least one spring 202 for biasing the secondary mass 210, such that the spring 202 provides a tensioning force less than that exerted by the primary mass 154. An alternate to the spring 202 may include a tensioning member between the primary mass 154 and the boot 70, such that the tensioning member is for biasing the secondary mass 210 and has a higher natural frequency than the primary mass 154, in which the tensioning member includes at least one of a spring, hydraulic plunger, pneumatic plunger, elastic material or other deformable material.

The primary 154 and secondary mass 210 therefore define a ski binding for controlled attachment and detachment with the ski boot 70 under static conditions and disengage in response to dynamic conditions sufficient to displace the primary mass 154, as the dynamic conditions (such as a ski fall) force the binding beyond the release threshold. In such an arrangement, configurations herein also include a complementary binding (e.g. toe or front) engaging an opposed end of the boot 70 from the binding 150. In the examples above, the binding 150 is a heel binding, and the binding assembly also includes the toe binding at the opposed end of the ski boot from the heel binding. The toe binding and the heel binding further including a receptacle for engaging a corresponding lip on the ski boot 70.

Figure 8:
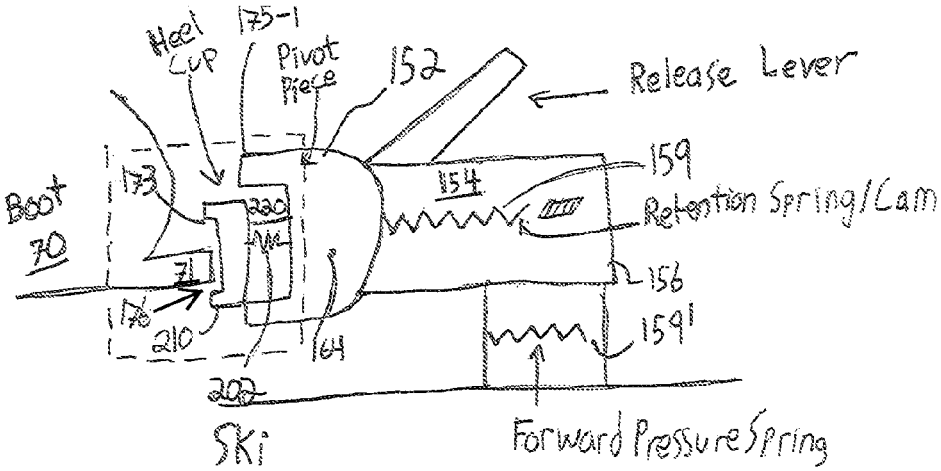
FIG. 8 shows an alternate configuration of a binding according to configurations herein.

FIG. 8 shows an alternate configuration of a binding according to configurations herein in engagement with a boot. Referring to FIGS. 7 and 8, the heel cup 210 slideably engages a receptacle 220 in the heelpiece 152. The receptacle 176 in the heel cup 210 engages a heel protrusion 71 on the boot 70. An arc or lip 173 on the upper protrusion 172-1 ensures that boot 70 contact occurs as far forward as possible on the heel protrusion 71. The spring 202 may be unitary or multiple springs may be used, as the spring 202 biases or forces the receptacle 176 in the heel cup 210 toward the boot 70 while slideably engaged in the heelpiece 152. A second spring 159' independently biases the mounting 156, while the spring 159 tensions the primary mass 154 of the mounting 156 according to the release threshold. The arc or lip 173, provides a concave or similar protrusion and edge on the receptacle 176, such that the edge contacts the lip at a point nearest the boot 70 on the boot protrusion 71.

Figure 9:
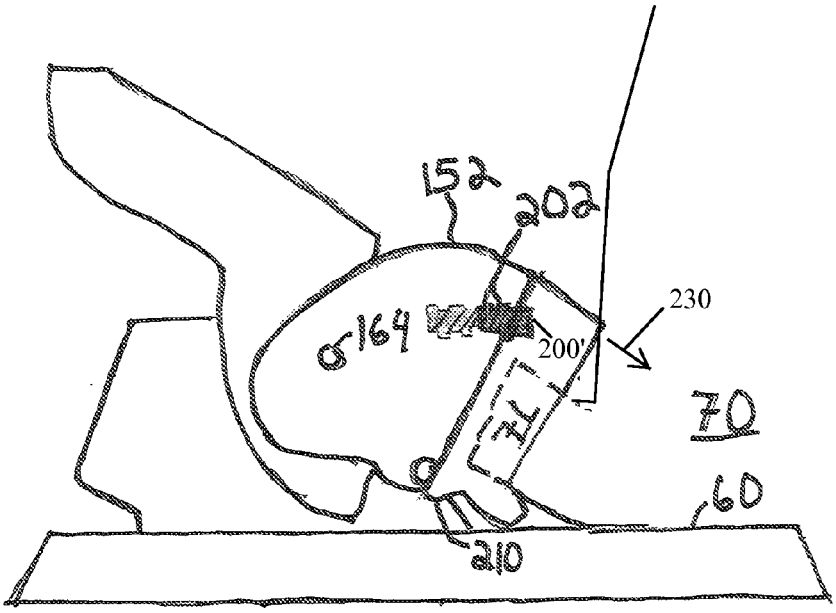
FIG. 9 shows a unitary pivot configuration in the binding of FIG. 8.

FIG. 9 shows a unitary pivot configuration in the binding of FIGS. 7 and 8. Referring to FIGS. 7-9, the heel cup 210 pivotally attaches to the heelpiece 152 at a heel pivot 165, biased in an arcuate direction by spring 202 and curved pin 200', as shown by arrow 230. The number and shape of the pins 200' may vary, as straight pins may be employed if tolerances between the heel cup 210 and heelpiece 152 allow. The arcuate engagement 230 offsets the arcuate movement of the boot 70 and heel protrusion 71 as the heelpiece 152 pivots upward around pivot 164. Therefore, the heelpiece 152 includes a pivotal linkage 165 between the primary mass 154 and the secondary mass 210 for offsetting angular displacement the primary mass 154 toward engagement of the secondary mass 210 with a heel protrusion 71 on the boot 70.

Figure 10:
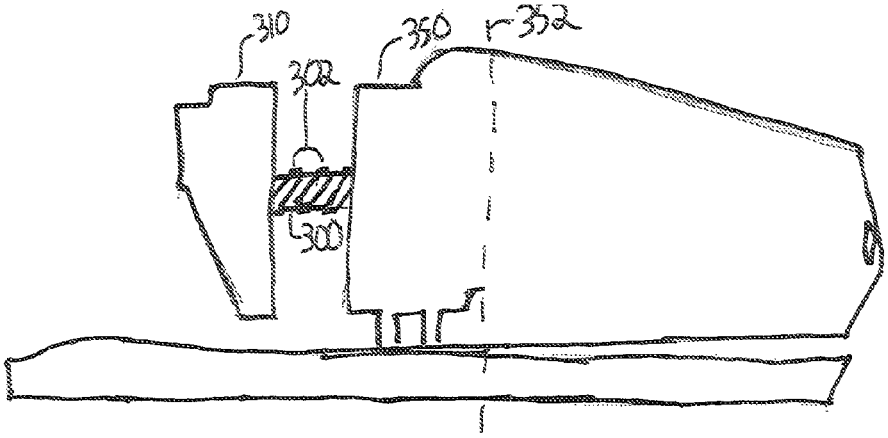
FIG. 10 shows a complementary toe binding corresponding to a heel binding as in FIGS. 8 and 9.

FIG. 10 shows a complementary toe binding corresponding to a heel binding as in FIGS. 8 and 9. In the disclosed configurations, the secondary mass provided by the heel cup 210 biased by the spring 202 mitigates IR from chatter and other scenarios. The toe binding 350 is spring biased to pivot outward, around axis 352, in the event of harmful forces against the boot 70. A complementary spring 302 and pin 300 assembly may be disposed in a toe binding 350 for engaging the boot 70 and securing a toe of the boot against the biasing force of the heel binding 150. The complementary spring 302 offsets displacement of the spring 202 to absorb movement and ensure that the boot remains engaged between the heel cup 210 and toe binding 350. The toe binding further provides an additional secondary mass 310, or complementary mass, for engaging the boot 70 toe while biased against the complementary spring 300. The toe binding therefore defines a complementary mass at the opposed end, such that the complementary mass 310 is biased toward the boot 70 for absorbing movement of the secondary mass 210 and maintaining engagement of the ski boot 70 during displacement of the secondary mass 210.

Figure 11:
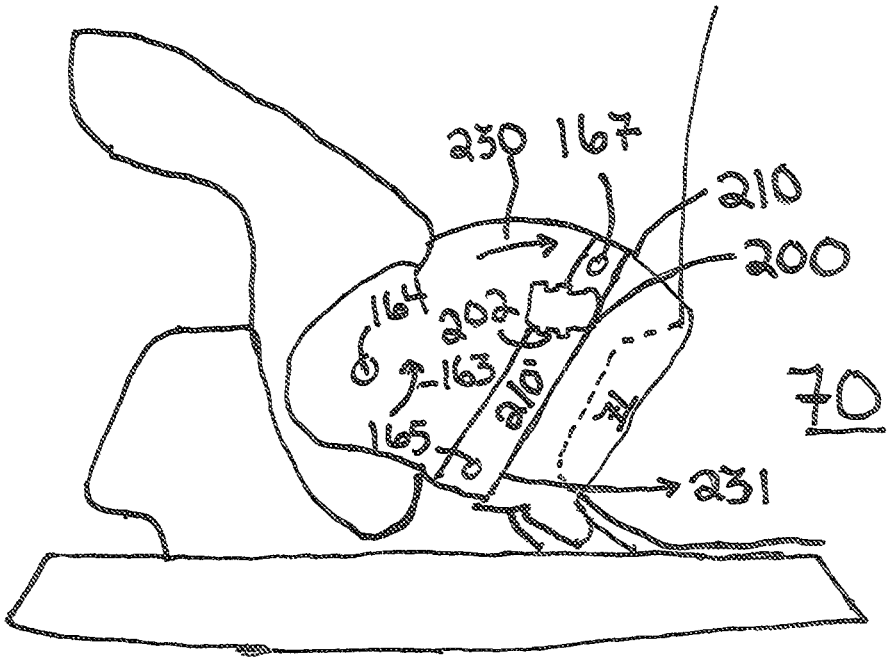
FIG. 11 shows a dual pivot configuration in the binding of FIG. 8.

FIG. 11 shows a dual pivot configuration in the binding of FIG. 9. Referring to FIGS. 9 and 11, a dual pivot arrangement allows the heel cup 210 to engage the boot protrusion 71 at a constant angle even as the heelpiece 152 displaces upwards. In FIG. 11, as the pivot 165 allows the heel cup 210 to pivot downward 230 as in FIG. 9 to offset upwards pivoting around the pivot 164 (arrow 163). A heel pivot piece 210' maintains a separate pivot 231 around an upper pivot 167, thus allowing the heelpiece 152 to maintain the same angle of engagement to the heel protrusion 71. Particular configurations, therefore, employ the dual pivot for disposing the secondary mass 210 against the boot 70 at a constant angle.

Figure 12:
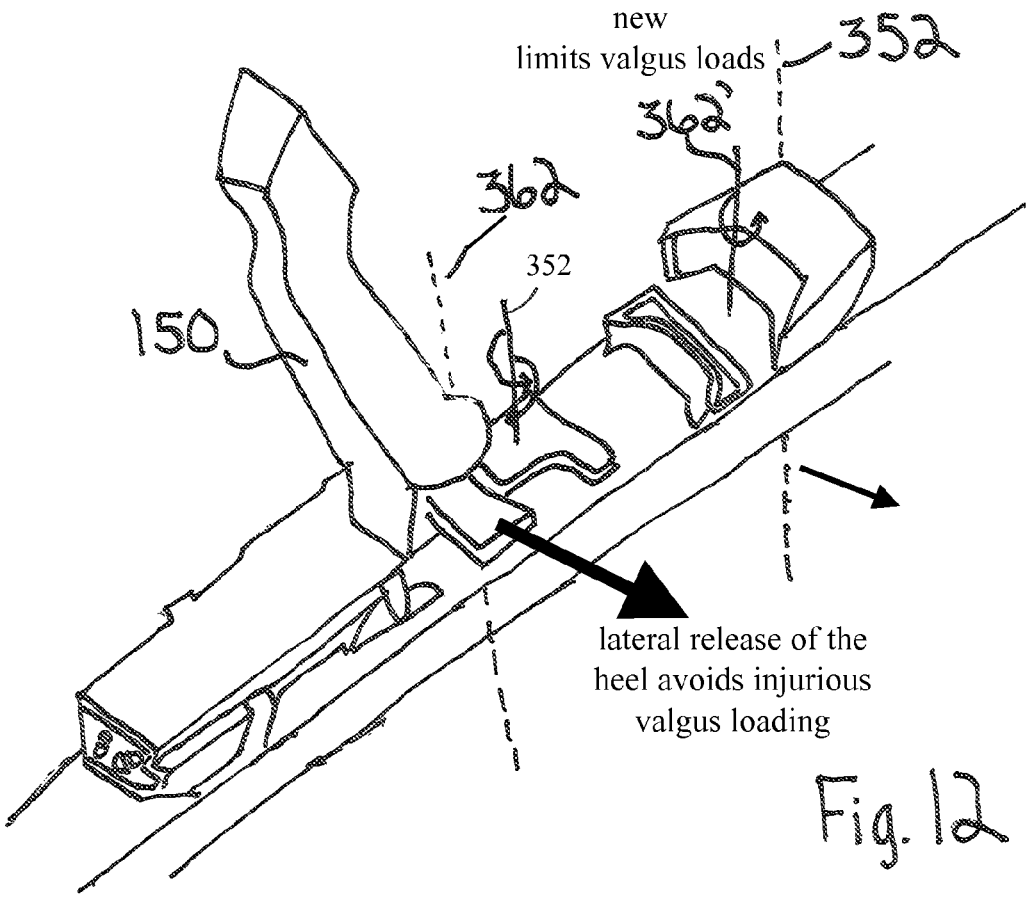
FIG. 12 shows an alternate configuration employing similar protections for both the heel and toe bindings.

FIG. 12 shows an alternate configuration employing similar protections for both the heel and toe bindings. The disclosed approach may also be extended to provide complementary operation at both the heel and toe. Referring to FIGS. 10 and 12, FIG. 10 shows the secondary mass 154 extended to the toe binding. FIG. 12 shows similar functionality of the toe binding applied to the rear binding. As indicated in FIG. 10, disengagement at the toe generally involves an outward pivot of the toe binding 350 around an axis 352, as the boot 70 toe displaces right or left, as shown by arrows 356 and 358, respectively. As shown in FIG. 12, this pivoting relieves strain around an axis 352' defined by the ankle of the skier. Similar capability can be applied to the heel binding 150 to prevent valgus loads (twisting) often associated with ACL (Anterior Cruciate Ligament) injury. Valgus loads result from a pivoting of the skier's ankle about an axis 362' defined by a toe of the skier. A pivoting of the heel binding 150 about an axis 362' absorbs these valgus loads, by permitting the heel binding 150 to pivot or rotate around the axis 362 to disengage the heel protrusion 71. In such a configuration, both the heel and toe bindings further include a secondary mass 210 for absorbing cyclic high frequency loads and pivotal rotation about an axis normal to the plane of the ski 60 for absorbing torsional loads.

While the methods and apparatus defined herein have been particularly shown and described with references to embodiments thereof, it will be understood by those skilled in the art that various changes in form and details may be made therein without departing from the scope of the invention encompassed by the appended claims.

What is claimed is:

1. A ski boot attachment interface device for engaging a ski boot to a ski, comprising a plurality of tensioned masses disposed between a ski boot and a mounting on a ski, each of the masses biased against the ski boot, the tensioned masses further comprising:

a primary mass, defined by a main body of the heel piece of the binding, biased against the ski boot for securing the boot to the ski against a threshold force indicative of injury; and a secondary mass, defined by a fast-response heel cup, disposed between the primary mass and the ski boot and biased to exert a different force than the primary mass;

the secondary mass engaging the ski boot for absorbing a load less than the threshold force for preventing inadvertent release (IR).

2. The device of claim 1 wherein the threshold force defines a displacement of the primary mass sufficient to release the ski boot from engagement with the ski, and the secondary mass is configured for displacement at a lesser force than the threshold force for absorbing displacement corresponding to an IR without disengaging the ski boot from the ski.

3. The device of claim 1 wherein the secondary mass is configured to absorb a load for increasing work required for triggering a release by disposing the primary mass against a threshold force indicative of injury.

4. The device of claim 3 wherein the primary mass and secondary mass define a ski binding for controlled attachment and detachment with the ski boot under static conditions and disengage in response to dynamic conditions sufficient to displace the primary mass.

5. The device of claim 4 further comprising a complementary binding engaging an opposed end of the boot from the binding.

6. The device of claim 4 wherein the binding is a heel binding, further comprising a toe binding at the opposed end of the ski boot from the heel biasing, the toe binding and the heel binding further comprising a receptacle for engaging a corresponding lip on the ski boot.

7. The device of claim 5 further comprising a complementary mass at the opposed end, the complementary mass biased toward the boot for absorbing movement of the secondary mass and maintaining engagement of the ski boot during displacement of the secondary mass.

8. The device of claim 6 further comprising a concave protrusion and edge on the receptacle, the edge contacting the lip at a point nearest the boot.

9. The device of claim 2 further comprising at least one spring for biasing the secondary mass, the spring providing a compression force less than that exerted by the primary mass.

10. The device of claim 2 further comprising a compression member between the primary mass and the boot, the tensioning member for biasing the secondary mass and having a higher natural frequency than the primary mass, the compression member including at least one of a spring, hydraulic plunger, pneumatic plunger, elastic material or other deformable material.

11. The device of claim 4 further comprising a pivotal linkage between the primary mass and the secondary mass for offsetting angular displacement the primary mass toward engagement of the secondary mass with a heel protrusion on the boot.

12. The device of claim 11 further comprising a dual pivot, the dual pivot for disposing the secondary mass against the boot at a constant angle.

13. The device of claim 6 wherein each of the heel and toe bindings further comprise a secondary mass for absorbing cyclic high frequency loads and pivotal rotation about an axis normal to the plane of the ski for absorbing torsional loads.

14. The device of claim 1 further comprising a fixed heel piece defining the primary mass, and the secondary mass defined by a fast-response-heel or toe cup with lighter mass than the fixed heel piece, the fast-response-heel-cup adapted to respond to and follow relative displacements between the binding toe and heel pieces resulting from dynamic loadings.

15. The device of claim 6 further comprising a pivoting mechanism in each of the heel and toe binding, the pivoting mechanisms adapted for sideways displacement of the boot around a respective pivot in response to a force exceeding the threshold force.

16. In a ski binding arrangement having a heel binding and a toe binding securing a ski boot to a ski, the heel binding biased against the boot for securing the boot between the heel binding and toe binding, a method for preventing inadvertent release (IR) of the ski, comprising:

disposing a primary biased member between the ski and the boot, the primary biased member adapted to yield for releasing the boot in response to a threshold force;

disposing a secondary biased member between the primary biased member and the boot, the secondary biased member having a mass less than the primary biased member.

* * * * *